US008543026B2

(12) United States Patent
Kim

(10) Patent No.: US 8,543,026 B2
(45) Date of Patent: Sep. 24, 2013

(54) TERMINAL DEVICE, PRINTING CHARGING SYSTEM, AND METHOD FOR CHARGING PRINTING COSTS

(75) Inventor: Geun-tae Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 603 days.

(21) Appl. No.: 12/324,999

(22) Filed: Nov. 28, 2008

(65) Prior Publication Data

US 2009/0238599 A1 Sep. 24, 2009

(30) Foreign Application Priority Data

Mar. 19, 2008 (KR) ..... 10-2008-0025310

(51) Int. Cl.
*G03G 15/00* (2006.01)

(52) U.S. Cl.
USPC ..... 399/79; 399/80

(58) Field of Classification Search
CPC ..... G03G 21/02
USPC ..... 399/43, 76, 79, 80, 86, 204, 364
See application file for complete search history.

(56) References Cited

U.S. PATENT DOCUMENTS

2005/0129423 A1* 6/2005 Lester et al. ..... 399/79
2006/0283937 A1* 12/2006 Daniel et al. ..... 235/382
2007/0019237 A1* 1/2007 Nobutani ..... 358/1.15

OTHER PUBLICATIONS http://infoservices.palomar.edu/instructions/gs4_user_guide_april08.pdf (pp. 6 and 41).*
http://librarylab.wikidot.com/print-release-station (p. 8).*

* cited by examiner

*Primary Examiner* — Walter L Lindsay, Jr.
*Assistant Examiner* — Barnabas Fekete
(74) *Attorney, Agent, or Firm* — Staas & Halsey LLP

(57) ABSTRACT

A method of charging printing costs using a printing charging system that is connected to an image forming apparatus, the method including: setting printing costs for each of a plurality of people; generating print data for each person, of the plurality of people, based on the set printing costs; and transmitting the generated print data to the image forming apparatus.

21 Claims, 8 Drawing Sheets

TERMINAL DEVICE, PRINTING CHARGING SYSTEM, AND METHOD FOR CHARGING PRINTING COSTS

CROSS-REFERENCE TO RELATED APPLICATION

This application claims the benefit of Korean Application No. 2008-25310, filed Mar. 19, 2008, in the Korean Intellectual Property Office, the disclosure of which is incorporated herein by reference.

BACKGROUND OF THE INVENTION

1. Field of the Invention

Aspects of the present invention relate to a terminal device, a printing charging system, and a method of charging printing costs, and more particularly, to a terminal device that charges users individually for printing costs when printing is performed, a printing charging system, and a method of charging printing costs.

2. Description of the Related Art

Generally, when a person wishes to print a document using a public image forming apparatus (such as in a public office or a computer laboratory in a university), the person pays printing costs. In this case, the person may print several copies of a single document, for example, for several friends if the document is a handout for study. Accordingly, the person pays printing costs for the friends as well as his or her own costs. Thus, the person may have to approach his or her friends and receive the money from them.

In particular, since printing costs are proportional to the number of printed sheets and printing costs for a single sheet are relatively small, the person who performs printing has to frequently receive coins. Therefore, an inconvenience arises.

SUMMARY OF THE INVENTION

Aspects of the present invention provide a terminal device that improves user convenience by charging users for printing costs when printing is performed, a printing charging system, and a method of charging printing costs.

According to an aspect of the present invention, there is provided a method of charging printing costs using a printing charging system that is connected to an image forming apparatus, the method including: setting printing costs for each of a plurality of people for a single print job; generating print data for each person, of the plurality of people, based on the set printing costs; and transmitting the generated print data to the image forming apparatus.

The method may further include notifying each person of the set printing costs, and receiving user confirmation of the printing costs.

The transmitting of the print data may include, if user confirmation of the printing costs is completed, the printing data for each person for whom confirmation is completed is transmitted to the image forming apparatus.

The user confirmation may include authenticating whether a person, of the plurality of people, is entitled to print material, and receiving approval from the authenticated person regarding the set printing costs.

The method may further include discarding print data of a person if the person does not confirm the printing costs within a predetermined period of time.

The transmitting of the print data may include transmitting the generated print data to a charging server, and transmitting the printing data from the charging server to the image forming apparatus if user confirmation is completed.

The method may further include displaying a charging state of the printing costs for each person.

According to another aspect of the present invention, there is provided a terminal device that is connected to an image forming apparatus, the terminal device including: a user interface to receive settings of printing costs for each of a plurality of people; a controller to generate print data for each person, of the plurality of people, based on the printing costs set by the user interface; and an interface to transmit the generated print data to the image forming apparatus.

The controller may notify each person of the set printing costs.

The controller may transmit the generated print data to the image forming apparatus if the person confirms the set printing costs.

The user interface may generate a user interface window to display a charging state of the printing costs for each person.

The user interface may generate a user interface window including a first area to input information on the plurality of people who share the printing costs, and a second area to input a ratio for sharing the printing costs for each person.

The user interface may generate a user interface window including an area to input a number of copies, a printing range, and/or a printing method for each person.

According to yet another aspect of the present invention, there is provided a printing charging system for an image forming apparatus, the printing charging system including: a terminal device to set printing costs for each person, and to generate print data for each person based on the set printing costs, and a charging server to receive the set printing costs and the generated print data, and to transmit the generated print data to the image forming apparatus if the person confirms the set printing costs.

The terminal device may transmit the generated print data to the charging server if the person confirms the set printing costs.

The terminal device may transmit the print data for each person to the image forming apparatus.

The terminal device may display a charging state of the printing costs for each person.

The charging server may notify each person of the set printing costs.

The charging server may store the received printing data, and may discard the stored printing data after a predetermined period of time.

According to still another aspect of the present invention, there is provided a method of charging printing costs for an image forming apparatus, the method including: setting printing costs for each of a plurality of people in a terminal device that generates print data for the plurality of people.

According to another aspect of the present invention, there is provided a terminal device that is connected to an image forming apparatus, the terminal device including: a controller to set printing costs for each of a plurality of people, and to generate print data for the plurality of people.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
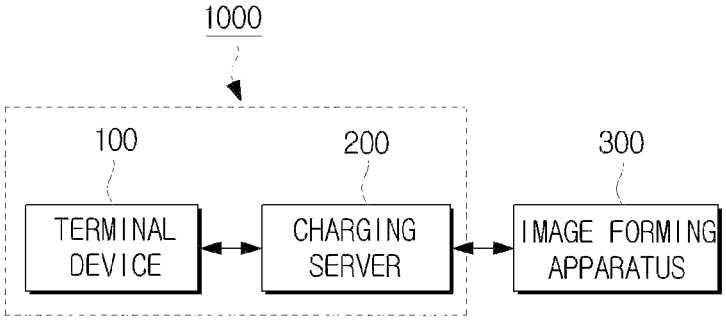
FIG. 1 illustrates a block diagram of a printing charging system according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

FIG. 1 illustrates a block diagram of a printing charging system 1000 according to an embodiment of the present invention. Referring to FIG. 1, the printing charging system 1000 includes a terminal device 100 and a charging server 200. If a print command is input, the terminal device 100 receives settings to charge printing costs for each person, and generates printing data for each person based on the settings. Detailed configuration and operation of the terminal device 100 is described herein with reference to FIG. 2.

Figure 2:
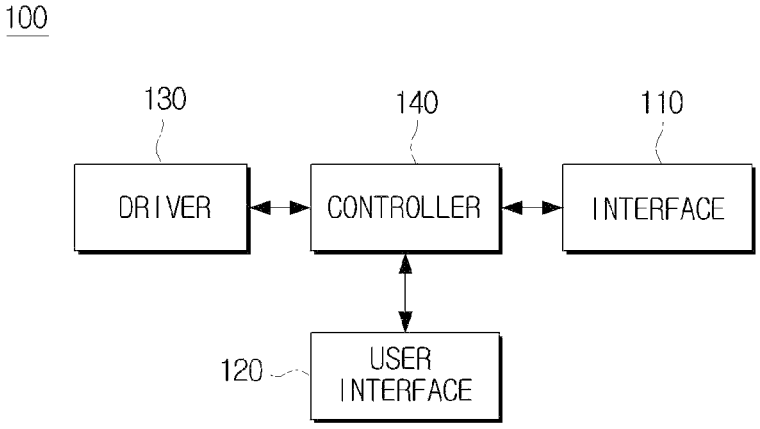
FIG. 2 illustrates a block diagram of a terminal device according to an embodiment of the present invention.

FIG. 2 illustrates a block diagram of the terminal device 100 according to an embodiment of the present invention. Referring to FIG. 2, the terminal device 100 includes an interface 110, a user interface (UI) 120, a driver 130, and a controller 140. The UI 120 includes a plurality of operation keys so that the user can set or select diverse operations of the terminal device 100. Furthermore, the UI 120 displays diverse information provided by the terminal device 100. The UI 120 may be implemented as a device, such as a touch pad, that simultaneously implements input and output operations. Conversely or additionally, the UI may include numerous devices for input and output (such as a mouse and a monitor). Accordingly, the user can set printing costs for each person using a UI window provided by the UI 120. A detailed description of the UI window is given below with reference to FIGS. 5 and 6.

Figure 5:
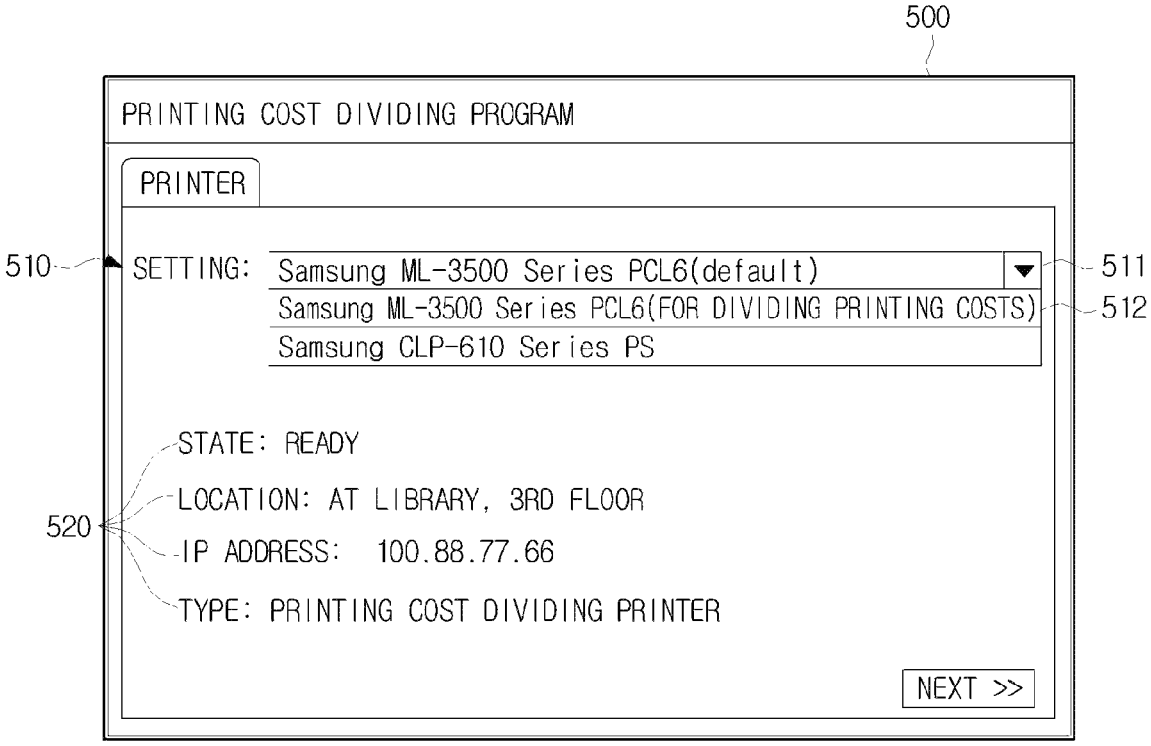
FIGS. 5 to 9 illustrate a configuration of a user interface window that is displayed on the terminal device according to an embodiment of the present invention.

FIG. 5 illustrates the configuration of a UI window to set whether to perform printing charging according to each person according to an embodiment of the present invention. Referring to FIG. 5, the UI window 500 includes a first area 510 to select a driver of an image forming apparatus, and a second area 520 to display information on the selected image forming apparatus. The second area 520 displays the state, location, IP address, and type of the selected image forming apparatus, though it is understood that aspects of the present invention are not limited thereto. For example, according to other aspects, the second area 520 displays only the state and/or location or additionally displays other characteristic information of the selected image forming apparatus. The first area 510 displays a list of image forming apparatuses that are connected to the terminal device 100. More specifically, if printing charging according to each person is not to be applied, the user selects a general driver 511 so that printing costs are charged to the user without printing charging according to each person. If printing charging according to each person is to be applied, the user selects a driver 512 to divide printing costs according to each person in the first area 510 so that setting printing costs for each person can be performed.

In the UI window 500 of FIG. 5, the general driver 511 is set as a default driver, though it is understood that aspects of the present invention are not limited thereto. For example, the driver 512 to divide printing costs may be set as the default driver. In addition, it is understood that the UI window 500 may decide whether to perform printing charging according to each person using different forms and/or different manners than the selecting of a driver.

Figure 6:
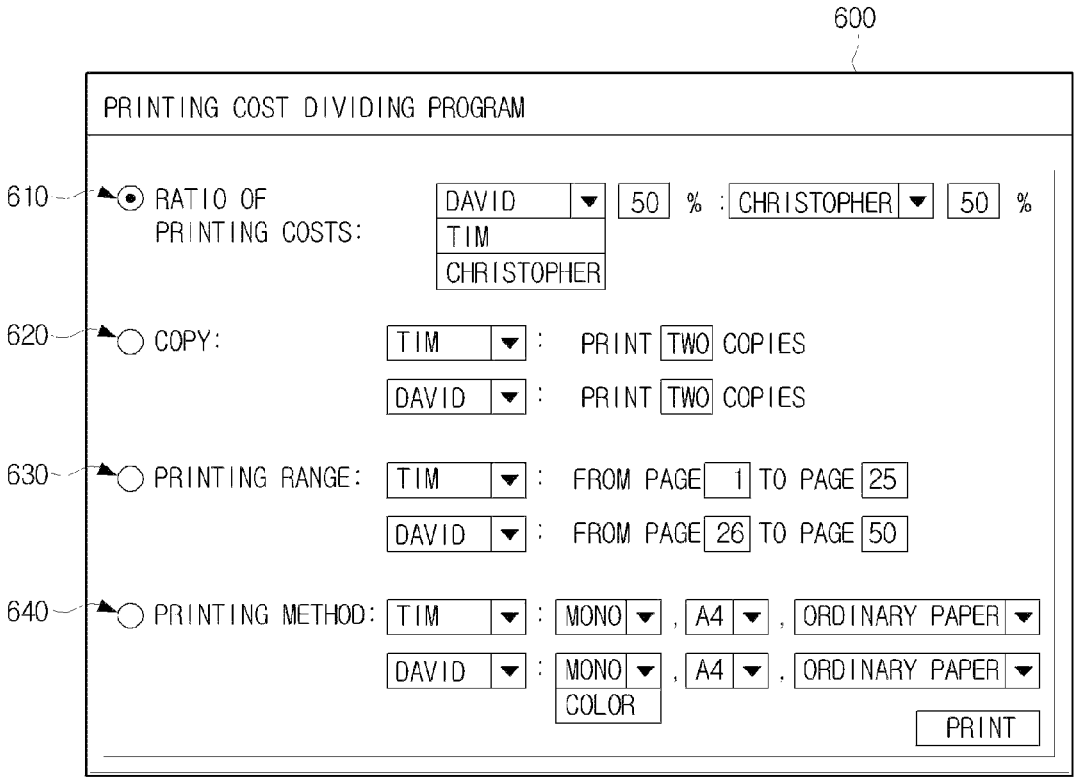

FIG. 6 illustrates a configuration of a UI window for setting a ratio of dividing printing costs according to an embodiment of the present invention. Referring to FIG. 6, a UI 600 includes items to select a "charge ratio," a "copy," a "printing range," and a "printing method." Furthermore, each item includes a first area to input information on a plurality of people that share printing costs, and a second area to input a ratio, copies, a page range, and/or a printing method according to each item.

According to aspects of the present invention, are a variety of methods to set printing costs for the plurality of people are provided. Here, a method to set printing costs using a "charge ratio" is described with reference to FIG. 6. In a method to set printing costs using the "charge ratio," printing costs are charged in a ratio for charging for each person. In more detail, if the user selects the "charge ratio" option 610, selects people with which to share printing costs in the first area, and inputs a charge ratio for each person in the second area, the UI 120 calculates and sets printing costs for each selected person using the total printing costs and the input charge ratio. In FIG. 6, the charge ratio is expressed as a percentage, though it is understood that aspects of the present invention are not limited thereto. For example, the charge ratio may be expressed as a fraction or a proportional expression.

A method to set printing costs using the "copy" option allows printing costs to be charged differently according to the number of copies for each person. In more detail, if the user selects the "copy" option 620, selects people with which to share printing costs in the first area, and inputs the number of copies according to each person in the second area, the UI 120 calculates and sets printing costs for each person using the total number of pages and the input number of copies for each person.

A method to set printing costs using the "printing range" option allows printing costs to be charged differently according to the printing range for each person. In more detail, if the user selects the "printing range" option 630, selects people with which to share printing costs in the first area, and inputs the printing range for each person in the second area, the UI 120 calculates and sets printing costs for each person using the input printing range for each person.

A method to set printing costs using the "printing method" option allows printing costs to be charged differently according to the printing methods of each person. In more detail, if the user selects the "printing method" option 640, selects people with which to share printing costs in the first area, and inputs a printing method (such as color printing, a size of paper (for example, A4, A3, B5, B4, etc.), and a type of print medium (for example, ordinary paper, color-dedicated paper, overhead projector (OHP) paper, etc.) for each person in the second area, the UI 120 calculates and sets printing costs for each person using the input printing method for each person. Moreover, it is understood that one or more of the above described methods (i.e., charge ratio, copy, printing range, and printing method) can be concurrently selected, so printing costs for each person can be calculated using the charge ratio, copies, printing range, and/or printing method input in the second areas. Furthermore, it is understood that other and/or additional options to set printing charges can be provided according to other aspects. For example, printing charges can be set according to a printing order in other aspects.

Referring back to FIG. 2, the UI 120 calculates printing costs for each person using information input by the user, and displays the information on the UI window 600. Furthermore, the UI 120 may generate a UI window that displays a charging state of printing costs. Such a UI window will be described below with reference to FIGS. 7 to 9.

The driver 130 converts a print document into print data in a printable format in order to print the print document generated, for example, using an application program. In this case, the user can set printing conditions using an operation provided by the driver 130 and/or the application program. Such a driver 130 may be included in the controller 140.

The controller 140 generates print data for each person based on printing costs set via the UI 120. The printing costs may include information on a person, the number of copies according to the person, the printing range, and/or the printing method, which are set by the user using the UI window 600. In more detail, the controller 140 controls the driver 130 to generate print data for each person based on corresponding option inputs that are included in the information on printing costs. For example, if the user selects the "printing range" in the UI window 600 and sets pages 1-25 for user 1 and pages 26-50 for user 2, the controller 140 generates print data 1 by converting pages 1-25, and generates print data 2 by converting pages 26-50. In addition, the controller 140 generates print data for each person by applying different printing options according to each person. For example, if the user selects the "printing method" in the UI window 600, and sets color printing and paper of A4 size for user 1 and mono printing and paper of B5 size for user 2, the controller 140 generates print data 1 by converting a printing document in color printing and paper of A4 size, and generates print data 2 by converting the printing document in mono printing and paper of B5 size.

The interface 110 is connected to the charging server 200 and provides the charging server 200 with the set printing costs and the generated print data. More specifically, the interface 110 connects the terminal device 100 to an external device, and may be implemented as a parallel port, a universal serial bus (USB) port, a wireless module, etc. Also, the interface 110 may be connected locally to the image forming apparatus 300 and, thus, can directly provide the image forming apparatus 300 with print data.

If the set printing costs are confirmed, the interface 110 receives information indicating that user confirmation is performed from the charging server 200, and transmits the generated print data to the charging server 200. In this case, the interface 110 may transmit print data for each person to the charging server 200 as each corresponding person confirms the printing costs. Alternatively, the interface 110 may collectively transmit all of the print data to the charging server 200 after all of the people confirm the printing costs. It is understood that according to other aspects, the confirmation is omitted from the method of setting printing costs.

The charging server 200 receives the printing costs and print data set for each person from the terminal device 100, and transmits the print data to the image forming apparatus 300 so as to print the print data. In greater detail, if the confirmation has already been performed, the charging server 200 transmits the print data to the image forming apparatus 300 so that the print data can be directly printed. When confirmation is performed by the terminal device 100, the charging server 200 provides the terminal device 100 with information used for user authentication. Conversely, if confirmation is not yet performed by the terminal device 100, the charging server 200 transmits the print data to the image forming apparatus 300 after the person confirms the printing costs. It is understood that, according to other aspects, the terminal device 100 or a different server may transmit the print data to the image forming apparatus, for example, after receiving a confirmation from the charging server.

In order to perform authentication of the selected people, the charging server 200 notifies all of the selected people of the set printing costs and requests that each person confirms the printing costs. Such a notification may be performed using a display, an external transmission, electronic mail, and/or a short messaging service (SMS). Furthermore, such a notification can be performed when printing is completed or when authentication of the persons is performed. More specifically, while performing authentication, the charging server 200 confirms whether a person who is currently performing authentication is an appropriate person to whom printing costs are distributed, using pre-stored information and information on the printing costs for each person that the terminal device 200 receives. Such a user authentication is similar to a user authentication generally performed in a network.

Subsequently, the charging server 200 requests that the authenticated person approve the charged printing costs. In greater detail, if printing is to be interrupted because printing costs of a person are incorrectly set or a printing range is incorrectly set, the person can deny the request of the charging server 200 so that the set printing costs are not charged. In this case, the charging server 200 cancels the printing operation for the person in response to the denial by the person.

In addition, the charging server 200 stores print data for each person and information on printing costs for each person. More specifically, if a person does not confirm a request to approve printing costs within a predetermined time period (such as two or three days) after the request to approve printing costs is made, the printing operation for the person is cancelled and stored print data is deleted. In this case, however, printing operations of other people can be maintained, so as not to be delayed. Furthermore, since print data is stored during the predetermined time period (for example, two or three days), user convenience is increased (for example, when the user desires in cancelling the operation or wishing to directly receive a printed document).

The image forming apparatus 300 receives and prints the print data. Examples of the image forming apparatus 300 include copiers, printers, facsimile machines, and multifunction peripherals (MFPs) incorporating operations of such abovementioned devices into a single device.

As described above, the printing charging system 1000 can set printing costs for each person, so a primary user does not personally charge each person the corresponding printing costs. In addition, settings of printing costs and other operations can be performed through the network, so user convenience can be improved. Furthermore, since the printing charging system 1000 generates and outputs print data for each person, and performs authentication and confirmation of each person, secure printing is guaranteed.

In FIGS. 1 and 2, the printing charging system includes the terminal device 100 and the charging server 200. However, it is understood that aspects of the present invention are not limited thereto. For example, the charging server 200 may include the operations of the terminal device 100 and perform all of the above-described operations of the printing charging system 1000, and vice versa. In addition, all of the operations of the printing charging system 1000 can be provided as a printer driver or a separate application. Moreover, in FIG. 1, the image forming apparatus 300 is connected locally to the charging server 200. According to other aspects, the image forming apparatus 300 may be connected to the terminal device 100 locally or via a network. In addition, the image forming apparatus 300 may be connected to the terminal device 100 or the charging server 200 through a wired and/or wireless connection.

Figure 3:
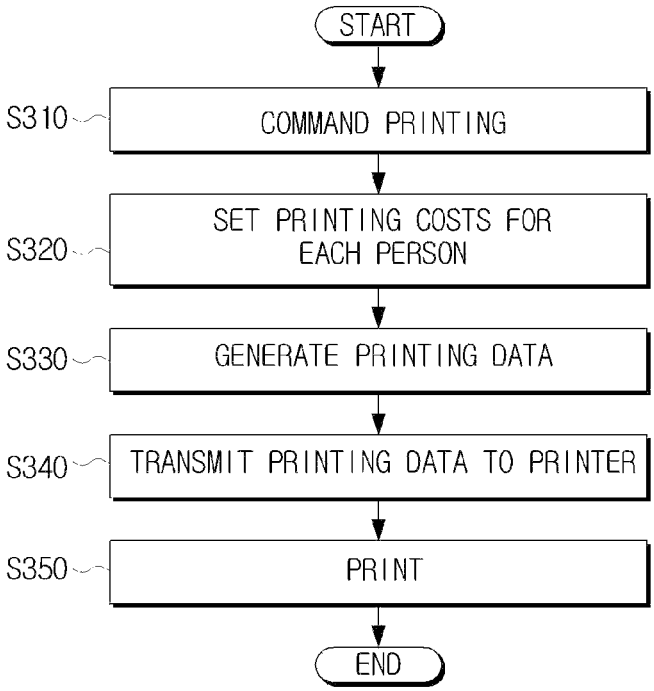
FIG. 3 illustrates a flowchart of a method of charging printing costs using the terminal device according to an embodiment of the present invention.

FIG. 3 illustrates a flowchart of a method of charging printing costs using the terminal device according to an embodiment of the present invention. Referring to FIG. 3, if a printing command is input in operation S310, printing costs for each person are set in operation S320. In greater detail, if a command to print a print document is input, information on a plurality of people that share printing costs, and a ratio of printing costs, copies, a page range, and/or a printing method for each person (as described above) are input in order to set printing costs for each person. Accordingly, printing costs for each person can be set using a "charge ratio," a "copy," a "printing range," and/or a "printing method." Detailed operations using such methods have been described above with reference to FIG. 6.

Figure 7:
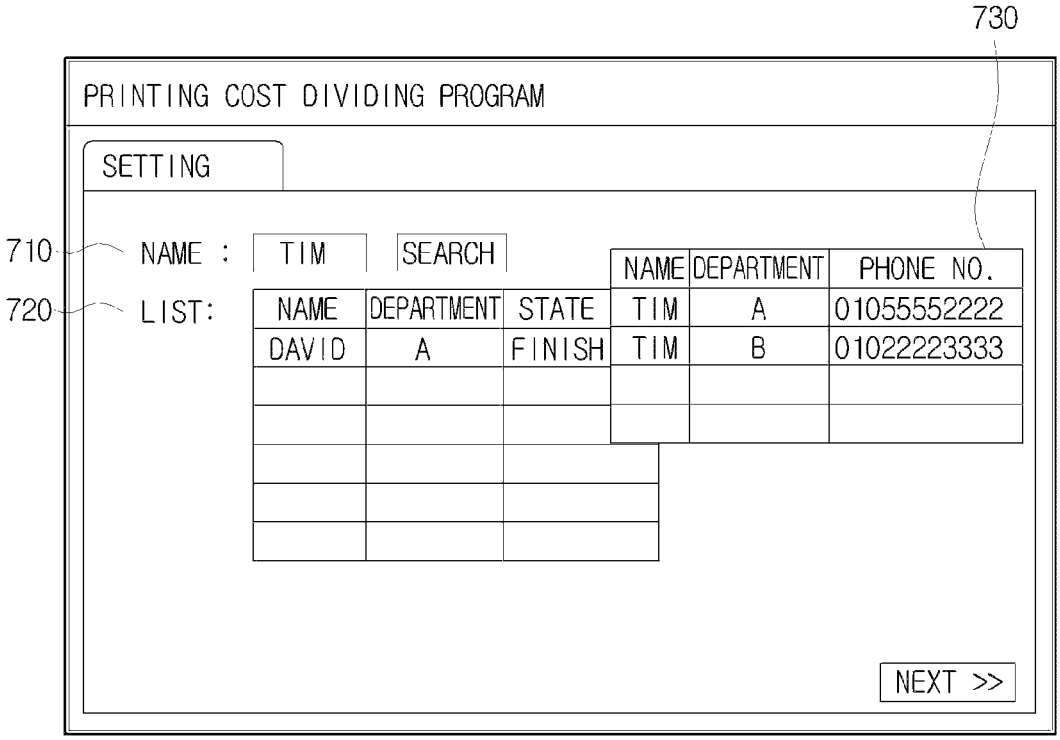
Figure 8:
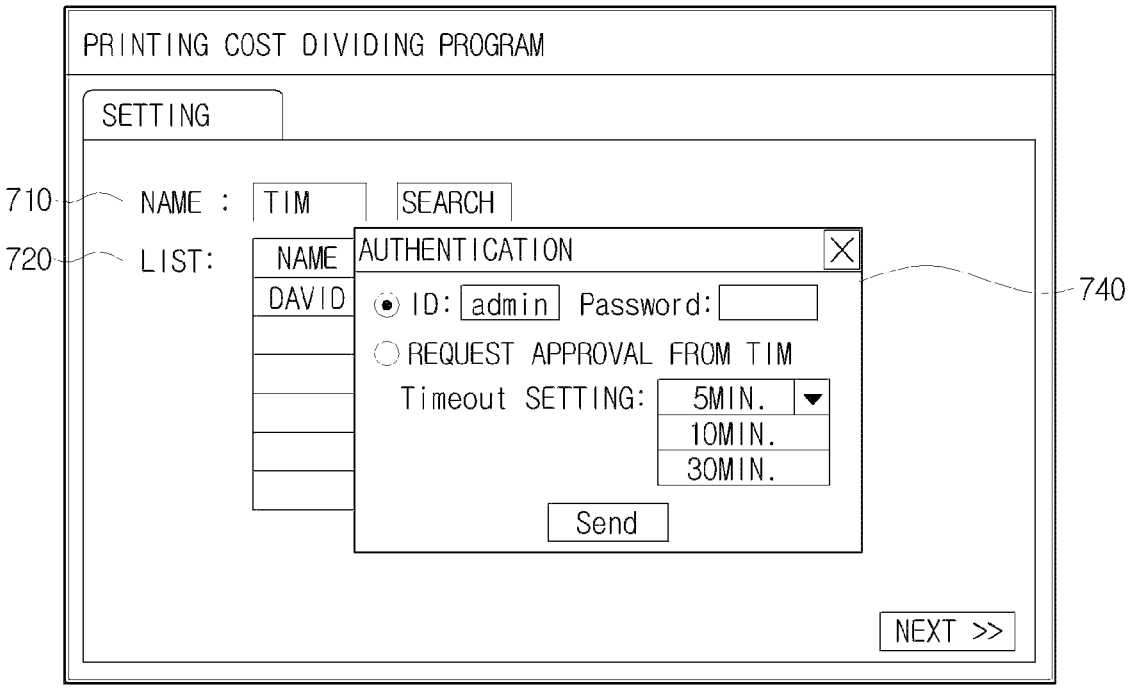
Figure 9:
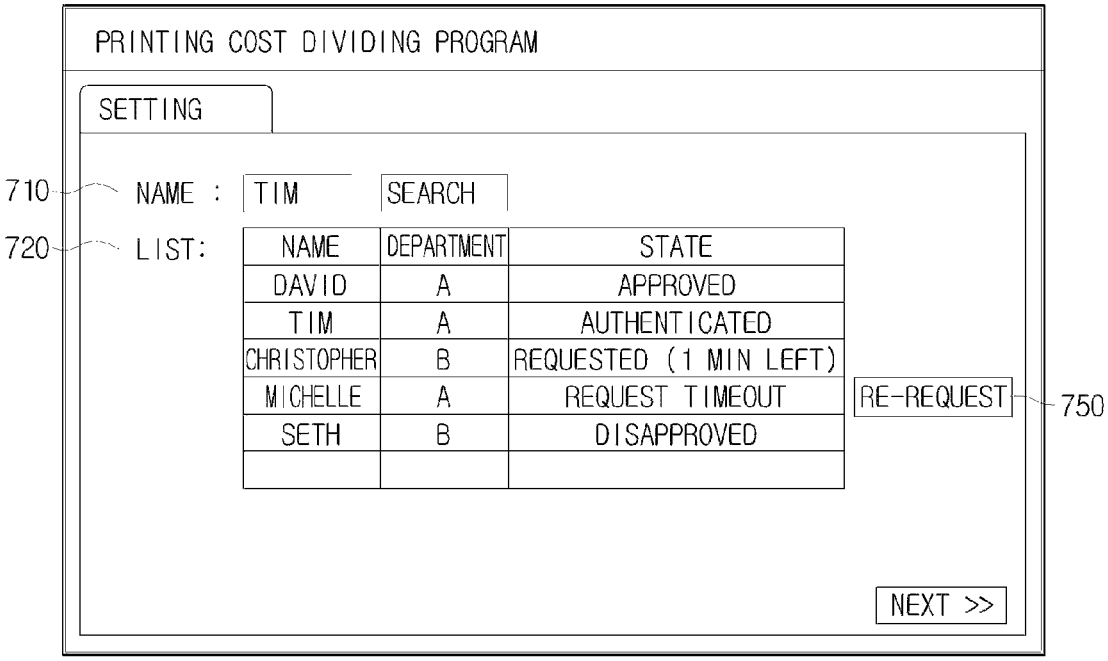

A person share printing costs may be selected when receiving authentication of the person. The process of selecting people that share printing costs is described in detail with reference to FIGS. 7 to 9. FIGS. 7 to 9 illustrate a configuration of a user interface window describing user authentication according to an embodiment of the present invention. Referring to FIGS. 7 to 9, the UI window 700 includes a first area 710 to select people that share printing costs and a second area 720 to display selected persons. In greater detail, if the user inputs or selects a name of a person in the first area 710, information on the person pre-stored in a database corresponding to the name is displayed in a certain area of the UI window 700. Accordingly, the user can select a printing user that shares printing costs using the displayed information. A person can be selected using a unique identification of the person (such as a corporate identification (ID) number or a school ID number other than the name). In this case, information on the person may be implemented to be directly selected instead of being displayed in the UI window.

If the user selects a person, a UI window 740 through which the selected person authenticates whether to share printing costs is displayed. The selected person may be authenticated by inputting an ID and a password that are preset by the selected person or by requesting authentication and approval of the selected person through the network. In order to request authentication and approval of the selected person through the network, a timeout is set, so authentication and approval can be performed during a certain period of time. However, it is understood that aspects of the present invention are not limited thereto. For example, alternatively, authentication and approval of the selected person can be performed by reading information of the ID card of the selected person using a radio frequency (RF) terminal. If there is an additional person to be selected, the above process is repeated.

The second area 720 to display selected persons displays a charging state of printing costs. With reference to FIG. 9, a charging state of printing costs is expressed as "approved," "authenticated," "requested," "request timeout," or "disapproved" in the second area 720. "Approved" indicates that a person has authenticated printing operation and approved the set printing costs. "Authenticated" indicates that a person has only authenticated a printing operation. "Requested" indicates that authentication and approval of a person are requested but the person has not authenticated the printing operation yet. "Request timeout" indicates that a person has not authenticated the printing operation within the preset time. "Disapproved" indicates that a person has authenticated printing operation but has denied the set printing costs.

The user can request re-authentication of a person who has not authenticated printing operation by selecting a re-request area 750 based on the displayed charging state of printing costs. If authentication of all of the people is completed or if authentication of a currently selected person is completed, printing costs of the people or the person can be set as described in FIG. 6.

Referring back to FIG. 3, based on the set printing costs, print data for each person is generated in operation S330. The printing costs may include information on a person, the number of copies according to the person, the printing range, and/or the printing method, which are set by the user using the UI window 600. Print data for each person is generated based, for example, on the number of copies and the printing range included in the printing costs information. In this case, print data can be generated by applying different printing options for each person.

Next, converted print data is transmitted to the image forming apparatus 300 in operation S340 and printed in operation S350. As a result, printing costs are charged differently according to each person. A person may be notified of printing costs via a display, an external transmission, mail, and/or SMS. Therefore, in such a method of charging printing costs, since the printing costs are set when performing printing, a primary user does not personally receive the printing costs from other persons after printing is completed, resulting in improved user convenience. In addition, setting of printing costs and other operations are performed through the network, so the user convenience is increased.

Figure 4:
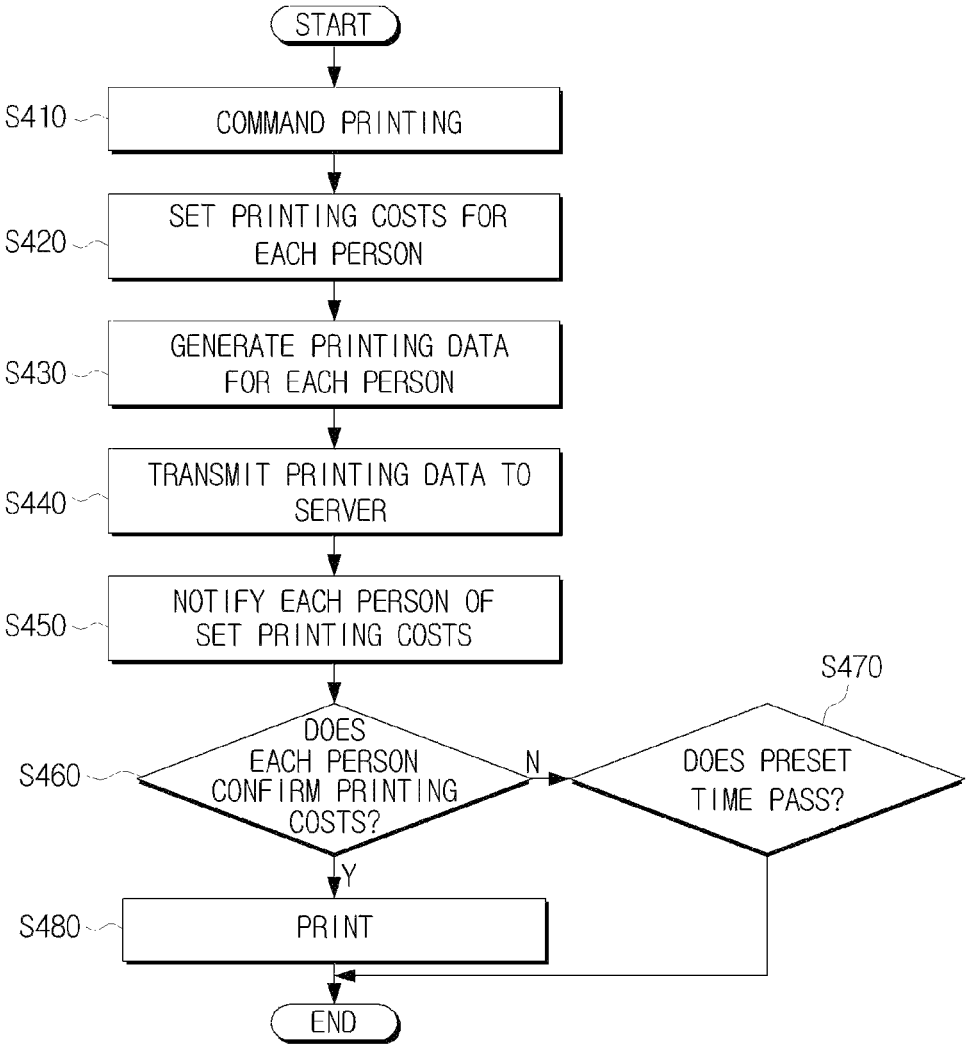
FIG. 4 illustrates a flowchart of a method of charging printing costs using the printing charging system according to an embodiment of the present invention.

FIG. 4 illustrates a flowchart of a method of charging printing costs using a printing charging system according to an embodiment of the present invention. Referring to FIG. 4, if a printing command is input in operation S410, printing costs for each person are set in operation S420. In greater detail, if a command to print a printing document is input, information on a plurality of people that share printing costs, and a ratio of printing costs, copies, a page range, and/or a printing method for each person (as described above) are input in order to set printing costs for each person. Accordingly, printing costs for each person can be set using a "charge ratio," a "copy," a "printing range," and/or a "printing method." Detailed operations using such methods have been described above with reference to FIG. 6.

Subsequently, based on the set printing costs, print data for each person is generated in operation S430. The printing costs may include information on a person, the number of copies according to the person, the printing range, and/or the printing method, which are set by the user using the UI window 600. Print data for each person is generated based, for example, on the number of copies and the printing range included in the printing costs information. In this case, print data can be generated by applying different printing options for each person.

The generated print data and the printing costs for each person are transmitted to the charging server 200 in operation S440. Alternatively, only the printing costs for each person are transmitted to the charging server 200, and then print data is transmitted to the charging server 200 after user authentication is performed or transmitted to a separate server or directly to the image forming apparatus 300.

Next, each person is notified of the set printing costs in operation S450. In detail, the set printing costs can be transmitted to the persons to request user confirmation using a display, an external transmission, electronic mail, and/or SMS.

Accordingly, each person confirms the charged printing costs in operation S460. Specifically, in the confirmation, the charging server 200 confirms whether a person who is currently performing confirmation is an appropriate person to whom printing costs are distributed. If the person is an appropriate person, the charged printing costs are confirmed by requesting approval of the charged printing costs. If the printing costs of the person are incorrectly set or a printing range is incorrectly set, the person can deny the request so that the set printing costs are not charged to the person. In contrast, if the set printing costs are appropriate, the request to approve the printing costs is confirmed and, thus, printing is performed.

The confirmation is performed within a preset time in operation S470. If a person does not confirm a request to approve printing costs in the preset time (for example, two or three days) after the request to approve printing costs is made, the printing operation for the person is cancelled and stored printing data is deleted. In this case, however, printing operations of other persons can be maintained, so that printing operations of other persons is not delayed. Furthermore, since print data is stored during the predetermined time period (for example, two or three days), user convenience, for example, in not confirming the operation or when wanting to directly receive a printed document can be guaranteed.

Even though operations S410 to S470 are described above using the terminal device 100 and the charging server 200, it is understood that according to other aspects, the operations of the charging server 200 can be incorporated into the terminal device 100 such that the terminal device 100 perform operations S410 to S470, and vice versa. As described above, since printing costs are distributed according to each person, user convenience can be improved.

Aspects of the present invention can also be embodied as computer-readable codes on a computer-readable recording medium. Also, codes and code segments to accomplish the present invention can be easily construed by programmers skilled in the art to which the present invention pertains. The computer-readable recording medium is any data storage device that can store data which can be thereafter read by a computer system or computer code processing apparatus. Examples of the computer-readable recording medium include read-only memory (ROM), random-access memory (RAM), CD-ROMs, magnetic tapes, floppy disks, and optical data storage devices. The computer-readable recording medium can also be distributed over network-coupled computer systems so that the computer-readable code is stored and executed in a distributed fashion. Aspects of the present invention may also be realized as a data signal embodied in a carrier wave and comprising a program readable by a computer and transmittable over the Internet.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A method of charging printing costs using a printing charging system for an image forming apparatus, the method comprising:

obtaining an input from a user selecting a plurality of users to apportion a total printing cost among the plurality of users;

setting printing costs for each of the plurality of users by obtaining an input from the user assigning a portion of the total printing costs to each user among the plurality of users;

generating, using at least one processor, print data for each user, of the plurality of users, based on the set printing costs; and transmitting the generated print data to the image forming apparatus.

2. The method as claimed in claim 1, further comprising:

notifying each user of the set printing costs; and receiving a user confirmation of the printing costs.

3. The method as claimed in claim 2, wherein the transmitting of the generated print data comprises:

transmitting the print data for a first user, of the plurality of users, if user confirmation of the printing costs is received for the first user; and transmitting the print data for a second user, of the plurality of users, if the user confirmation of the printing costs is received for the second user.

4. The method as claimed in claim 2, wherein the receiving of the user confirmation comprises:

authenticating whether a respective user, of the plurality of users, is entitled to print material; and receiving approval from the authenticated user regarding the set printing costs.

5. The method as claimed in claim 2, further comprising:

discarding print data of a user, of the plurality of users, prior to the print data being received by the image forming apparatus, if the user does not confirm the corresponding printing costs within a predetermined period of time.

6. The method as claimed in claim 2, wherein the transmitting of the generated print data comprises:

transmitting the generated print data to a charging server that receives the user confirmation of the printing costs; and transmitting the print data from the charging server to the image forming apparatus after receiving the user confirmation.

7. The method as claimed in claim 2, further comprising:

displaying a charging state of the printing costs for each user, of the plurality of users.

8. The method as claimed in claim 2, wherein the setting of the printing costs, the generating of the print data, the receiving of the user confirmation, and the transmitting of the print data is performed by a terminal apparatus.

9. A terminal device that is connected to an image forming apparatus, the terminal device comprising:

a user interface to obtain an input from a user selecting a plurality of users to apportion a total printing cost among the plurality of users, and to receive settings of printing costs for each of the plurality of users by obtaining an input from the user assigning a portion of the total printing costs to each user among the plurality of users;

a controller to generate print data for each user, of the plurality of users, based on the set printing costs; and an interface to transmit the generated print data to the image forming apparatus.

10. The terminal device as claimed in claim 9, wherein the controller notifies each user of set printing costs.

11. The terminal device as claimed in claim 10, wherein the controller transmits the generated print data for a first user, of the plurality of users, to the image forming apparatus if the first user confirms the corresponding set printing costs, and transmits the generated print data for a first user, of the plurality of users, to the image forming apparatus if the first user confirms the corresponding set printing costs.

12. The terminal device as claimed in claim 10, wherein the user interface generates a user interface window to display a charging state of the printing costs for each user, of the plurality of the users.

13. A terminal device that is connected to an image forming apparatus, the terminal device comprising:

a user interface to obtain an input from a user selecting a plurality of users to share a total printing cost among the plurality of users, and to receive settings of printing costs for each of the plurality of users;

a controller to generate print data for each user, of the plurality of users, based on the set printing costs; and an interface to transmit the generated print data to the image forming apparatus, wherein the user interface generates a user interface window including a first area to input information on the plurality of users, and a second area to input a ratio for sharing the printing costs for each user, of the plurality of users.

14. The terminal device as claimed in claim 9, wherein the user interface generates a user interface window including an area to input a number of copies, a printing range, and/or a printing method for each user, of the plurality of users.

15. The terminal device as claimed in claim 9, wherein the controller generates the print data according to a printing range and/or a printing method for each user.

16. A printing charging system, comprising:

a terminal device to obtain an input from a user selecting a plurality of users to apportion a total printing cost among the plurality of users, to set printing costs for each of the plurality of users by obtaining an input from the user assigning a portion of the total printing costs to each user among the plurality of users, and to generate print data for each of the plurality of users based on the set printing costs; and a charging server to receive the set printing costs to apportion a total printing cost among the plurality of users, to receive the generated print data, and to transmit the generated print data to an image forming apparatus according to a confirmation by the plurality of users, of the set printing costs.

17. The printing charging system as claimed in claim 16, wherein the terminal device transmits the generated print data for a first user, of the plurality of users, to the charging server if the first user confirms the set printing costs, and transmits the generated print data for a second user, of the plurality of users, to the charging server if the second user confirms the set printing costs.

18. The printing charging system as claimed in claim 17, wherein the terminal device transmits the print data for each user to the image forming apparatus.

19. The printing charging system as claimed in claim 16, wherein the terminal device displays a charging state of the printing costs for each user.

20. The printing charging system as claimed in claim 16, wherein the charging server notifies each user of the set printing costs.

21. The printing charging system as claimed in claim 16, wherein the charging server stores the received print data, and discards the stored printing data after a predetermined period of time.

* * * * *